US006244154B1

(12) United States Patent
Beebe et al.

(10) Patent No.: US 6,244,154 B1
(45) Date of Patent: Jun. 12, 2001

(54) SEATING DIE FOR FIREARM CARTRIDGES

(75) Inventors: Richard W. Beebe, Cortland; Patrick T. Ryan, Oxford, both of NY (US)

(73) Assignee: Redding Hunter, Inc., Cortland, NY (US)

( * ) Notice: Subject to any disclaimer, the term of this patent is extended or adjusted under 35 U.S.C. 154(b) by 0 days.

(21) Appl. No.: 09/473,178

(22) Filed: Dec. 28, 1999

(51) Int. Cl.[7] ..... F42B 33/10
(52) U.S. Cl. ..... 86/43; 86/23; 86/24
(58) Field of Search ..... 86/23–33, 43

(56) References Cited

U.S. PATENT DOCUMENTS

| | | | | |
|---|---|---|---|---|
| 3,440,923 | * | 4/1969 | Purdie | 86/43 |
| 4,385,545 | * | 5/1983 | Duer | 86/43 |
| 4,836,078 | * | 6/1989 | Lee | 86/23 |
| 4,862,567 | | 9/1989 | Beebe . | |
| 4,869,148 | * | 9/1989 | Tucker | 86/43 |

FOREIGN PATENT DOCUMENTS

| | | | | |
|---|---|---|---|---|
| 366482 | * | 12/1938 | (IT) | 86/43 |

* cited by examiner

*Primary Examiner*—Harold J. Tudor
(74) *Attorney, Agent, or Firm*—Wall Marjama & Bilinski

(57) ABSTRACT

A seating die for use in a reloading press containing a stationary head and a movable ram. The die is secured in the head of the press and the ram moves a cartridge containing a shell casing and an unseated bullet upwardly into the die. The die further includes an elongated housing having a passage passing axially therethrough. The lower part of the passage forms a guideway that opens into an expanded upper opening to form a shoulder therebetween. A guide having a body that is slidably mounted in the guideway and has a shank mounted at its proximal end that passes upwardly into the upper opening of the passage. A collar is mounted upon the shank that contains a radial flange that seats against the housing shoulder when the guide is in a home position. The distal end of the body section contains a bottom opening chamber for receiving the bullet as the ram moves upwardly whereupon the guide is moved upwardly into contact with an adjustable stop. Further upward movement of the ram securely seats the bullet within the shell casing.

5 Claims, 1 Drawing Sheet

SEATING DIE FOR FIREARM CARTRIDGES

FIELD OF THE INVENTION

This invention relates to the reloading of firearm cartridges and, in particular, to a seating die for use in a reloading press.

BACKGROUND OF THE INVENTION

Many avid hunters and competitive target shooters prefer to reload their cartridges in an effort to attain greater accuracy. A reloading press is conventionally used for this purpose. Typically, the press contains a stationary head for supporting one or more dies used in the reloading process and a coacting movable ram for moving cartridges into and out of the dies. One important aspect of the reloading press is the ability to properly seat a bullet within a shell casing to attain a desired depth of penetration of the bullet into the open casing. It is important that the bullet be axially aligned with the casing as it passes into the neck region of the casing. Any misalignment between the bullet and the casing will result in the casing material becoming distorted and the bullet being improperly seated in assembly. This, of course, results in inaccurate firing of the bullet and oftentimes damages the casing to a point where it cannot be again reloaded.

There have been many attempts to improve seating dies for use in a reloading press. U.S. Pat. No. 4,862,567 to Beebe, which is incorporated herein by reference, teaches of a seating die which includes inner and outer guide members that are disposed within a housing. The inner guide member is slidably contained within the outer guide member and moves axially between a home position and a stop position. The inner guide member has a contoured upper chamber for receiving a bullet therein. The outer guide member further includes a contoured lower chamber for receiving a shell casing and the lower chamber communicates with a smaller upper chamber of the inner guide member that receives the bullet therein. As a ram moves the bullet and the casing into the die, both the bullet and the casing become firmly seated in their respective chambers. Further movement of the ram causes the inner guide member to contact a first stop, thus arresting the upward motion of the bullet. The second guide member and shell casing, however, are permitted to continue their upward progress until the outer guide contacts a second stop at which time the bullet is well seated within the neck of the shell casing. Although this seating die works quite well for large caliber rifle cartridges with shell casings having a bottle neck configuration, it is not adaptable for use when seating small caliber handgun cartridges wherein the shell casings generally have a straight wall configuration

SUMMARY OF THE INVENTION

It is therefore an object of the present invention to improve seating dies used to load cartridges having straight wall casings of the type commonly used in most handguns and some small caliber rifles.

It is another object of the present invention to provide a seating die having a simplified construction and less moving parts when compared to those presently found in the prior art.

It is yet another object of the present invention to improve the accuracy or reloaded cartridges having straight wall shell casings.

These and other objects of the present invention are attained by a seating die for handgun cartridges for use in a reloading press that has a ram for supporting a straight wall shell casing and an unseated bullet in axial alignment with a die and a mechanism for producing relative motion between the ram and the die whereby the two move toward and away from each other along a common axis. The die includes an elongated housing having a chamber passing therethrough so that a cartridge mounted on the ram can pass into the chamber through the bottom opening in the housing. A seating stem is slidably contained in the chamber for movement along the axis of the housing and having a contoured opening in the bottom thereof for receiving the ogive of the bullet as the ram and die come together whereby the seating stem is moved upwardly in the chamber. A stop is mounted in the chamber and is arranged to arrest the movement of the seating stem whereupon the bullet is seated within the casing. A coil spring is mounted within the chamber and acts between the seating stem and a cap mounted in the top of the housing to place a continuous biasing force upon the seating stem as it moves within the chamber to axially align the unseated bullet with the shell casings and maintain the two in alignment as the bullet is arrested against the stop.

BRIEF DESCRIPTION OF THE DRAWINGS

For a better understanding of these and other objects of the present invention, reference will now be made to the following detailed description of the invention which is to be read in conjunction with the accompanying drawings, wherein.

DETAILED DESCRIPTION OF THE INVENTION

Figures 1, 2, 3, 4, 5:
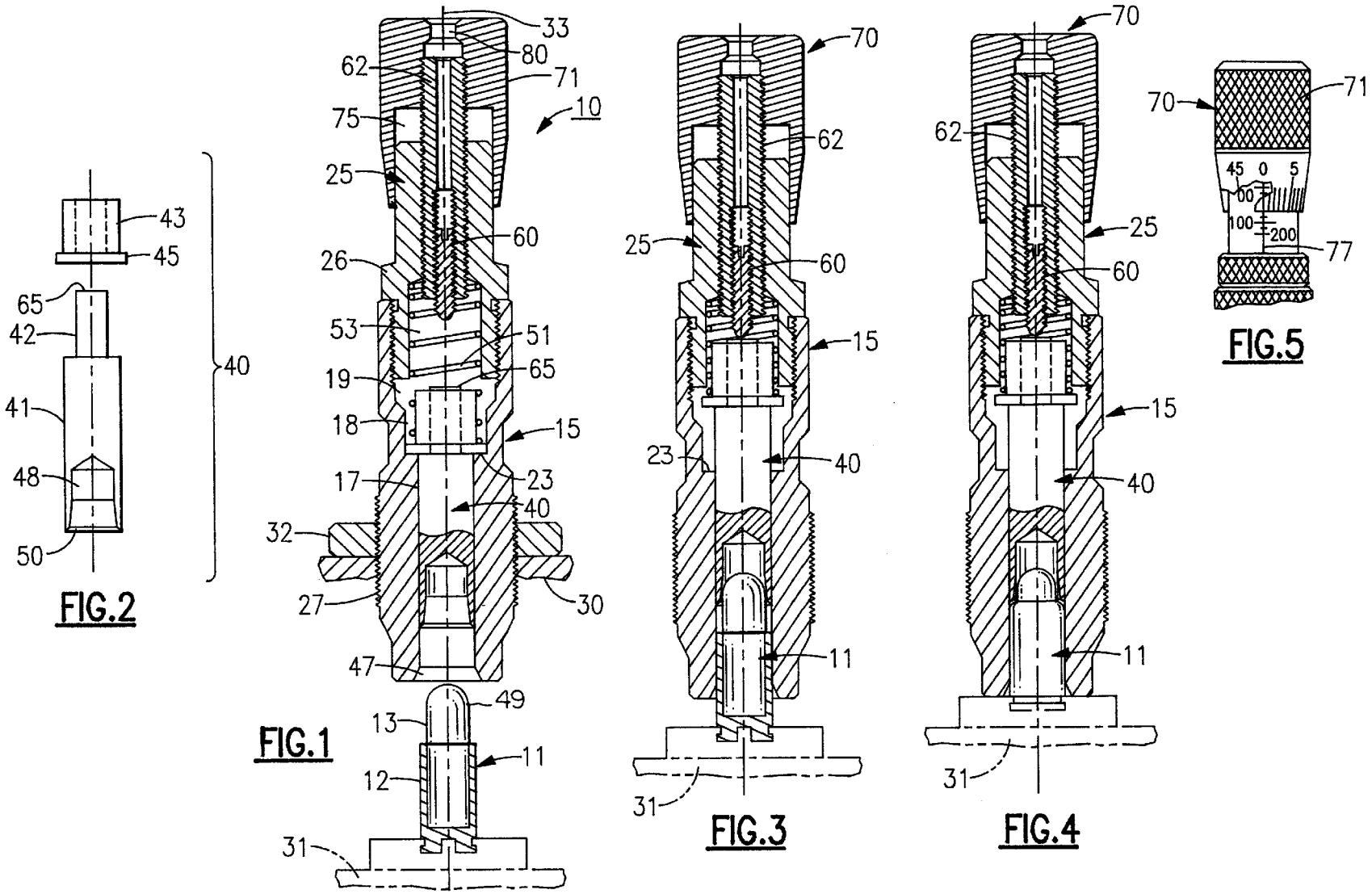
FIG. 1 is a side elevation view, in section, of a seating die embodying the teachings of the present invention showing the die mounted in the stationary head of a reloading press, and a shell casing, and the bullet positioned on the movable ram of the press below the stationary head.
FIG. 2 is an exploded side elevation, in section, showing a guide member contained in the die illustrated in FIG. 1.
FIG. 3 is a view similar to that shown in FIG. 1 illustrating the bullet aligned within the guide member of the die.
FIG. 4 is also a view similar to that shown in FIG. 1 illustrating a bullet fully seated within the shell casing.
FIG. 5 is a partial side elevation showing a micrometer type adjustment head having a graduated scale for setting and maintaining the depth of penetration of the bullet into the casing.

For ease of understanding, some of the component parts will be described as having proximal and distal ends as well as top and bottom sections. These terms are meant to be relative and are not intended to be limiting. Referring now to FIGS. 1–4, there is illustrated a seating die, generally referenced 10, that is suited for use in a press for reloading a cartridge 11 of the type typically used in most hand guns and some rifles. The term cartridge is used herein to include a straight wall shell casing 12 for holding a charge and a bullet 13 that closes the open end of the cartridge and is ultimately propelled out of a gun barrel when the cartridge is fired. The term straight wall shell casing, as herein used, refers to a shell casing that is not necked down at the bullet receiving end and which has a substantially uniform diameter along the length.

The seating die 10 further includes an elongated housing 15 that contains a chamber passing axially therethrough. The chamber contains a lower opening or guideway 17, an intermediate opening 18 and a larger upper opening 19. The openings are expanded radially in series so that the guideway has a smaller cross sectional area than the intermediate opening and the intermediate opening, in turn, has a smaller cross sectional area than the upper opening. A radial shoulder 23 is formed between the guideway and the intermediate opening, the purpose of which will be explained in further detail below.

The upper opening in the housing is closed by a cap generally referenced 25 that is threaded into the top of the upper opening. The cap contains a circular land 26 which, in assembly, is tightened down against the top surface of the housing to secure the cap in place.

The housing further includes a threaded section 27 containing a male thread that is designed to mate with a female thread formed in the stationary head 30 of a loading press to secure the die in axial alignment over the movable ram 31 of the press. The housing is secured in place by means of a locknut 32. A shell casing 12 to be loaded is mounted in the ram of the press in an upright position beneath the die with the casing being axially aligned with the centerline 33 of the chamber contained in the die housing. A bullet 13 is mounted upon the shell casing in an unseated condition as illustrated in FIG. 1. Upward movement of the ram moves the cartridge upwardly along the axis of the housing so that the bullet end of the cartridge can enter the guideway of the housing as illustrated in FIG. 3.

A seating stem 40 is slidably contained within the guideway of the housing. The seating stem, as best illustrated in FIG. 2, includes a cylindrical body 41 and a thinner upper shank 42 that is aligned axially with the body and extends upwardly from the proximal end of the body. A collar 43 is mounted upon the shank and contains a radially extended flange 45 that extends outwardly beyond the sidewall of the body section. The collar and the flange are preferably integrally formed and secured to the guide shank with the flange seated against the proximal end of the guide body. The flange and collar may also be two separate components that are individually mounted upon the shank and secured to the shank by press fitting, staking, welding, or the like.

In assembly, the cap 25 is removed from the housing and the body of the seating stem is passed downwardly into the guideway and the flange 45 is addressed against the shoulder 23 formed in the housing to locate the guide in a home position as illustrated in FIG. 1 and prevent the seating stem from passing out of the housing chamber through the lower entrance 47. At this time, the distal end of the guide body is located a short distance from the lower entrance 47 of the chamber. As shown in FIG. 2, the distal end of the seating stem contains an open ended bullet chamber 48 that complements the shape of the bullet ogive 49 and is adapted to receive the bullet therein as the ram moves upwardly into the die.

A coil spring 51 is wound about the collar of the seating stem and is adapted to act between the top wall of a blind hole 53 formed in the top cap 25 of the housing 15 and the flange 45 contained on the seating stem. The spring is arranged to produce a downwardly acting biasing force upon the seating stem regardless of its axial position within the housing chamber which, as will be explained below, provides for positive alignment of the bullet with the shell casing as they enter the chamber and maintain this alignment throughout the entire seating process.

Turning now to FIGS. 3 and 4, the bullet is initially inserted into the die along with the shell casing through the bottom entrance in the die housing. As the ram moves the cartridge upwardly through the lower guideway, the ogive of the bullet enters the bullet chamber 48 in the seating stem. The bullet and the shell casing are now coaxially aligned along the axis of the seating die due to the spring action. As the ram moves further in an upward direction, the seating stem is moved into arresting contact with a stop rod 60 thereby preventing farther movement of the bullet. The shell casing, at this time, continues to move upwardly under the influence of the ram until such time as the bullet is fully seated within the shell casing. When the guide is arrested against the stop mechanism, the compression spring becomes more fully compressed between the seating stem and the housing cap to again maintain the bullet in accurate alignment with the shell casing as the bullet is being seated. Releasing the ram by moving the ram downwardly toward its original starting position allows the spring to return the guide to its home position.

The stop mechanism includes a hollow shaft 62 that contains both external threads and internal threads. The shaft, in turn, is threaded into a central bore formed in the housing cap. The stop rod 60, in turn, is threadably contained within the hollow shaft 62. The rod protrudes downwardly from the bottom of the cap into the upper opening in the housing where it is capable of contacting the top surface 65 (FIG. 2) of the guide shank.

The depth of penetration of the bullet into the shell casing is closely controlled by means of a micrometer type adjusting head 70 illustrated in FIG. 5. The micrometer head includes a barrel shaped spindle 71 that is attached to the rod 62 of the stop mechanism and locked in place so that the rod and spindle turn as a unit. The spindle has a cylindrical opening 75 formed in the bottom section thereof that permits the top of the cap to pass into the opening as illustrated. A graduated scale 77 is scribed vertically upon the outer surface of the cap and circumferentially about the spindle. In operation, the scale is brought to a zero setting and the stop rod is brought to a desired depth by turning the set screw within the shaft by passing a suitable tool downwardly through the opening 80, provided in micrometer head. By using the scale, the position of the set screw can be adjusted to closely control the depth of penetration of the bullet into the shell casing.

While this invention has been explained with reference to the structure disclosed herein, it is not confined to the details set forth and this invention is intended to cover any modifications and changes as may come within the scope of the following claims:

What is claimed is:

1. A seating die for handgun cartridges for use in a reloading press that has a ram for supporting a straight wall shell casing and an unseated bullet in axial alignment with a die and means for producing relative axial movement between the ram and said die, said die including an elongated housing having an axially disposed chamber passing therethrough whereby a cartridge supported on the ram is passed into said opening as the ram and die are moved toward each other, a seating stem having a body section that is slidably contained in said chamber for movement along the axis of the chamber, said seating stem having a contoured opening at one end for receiving the bullet ogive therein as the ram and die come together whereby said seating stem is moved upwardly in said chamber as the cartridge continues to move upwardly in said chamber, a stop means positioned in the chamber for arresting the upward movement of said seating stem whereby further movement of the die and ram toward each other will cause the bullet to be seated within said shell casing, and spring means mounted within said housing that acts upon the seating stem, said spring being arranged to place a biasing force upon said seating stem to positively align the bullet with the shell casing and maintain the bullet and shell casing in alignment as they move upwardly in said chamber.

2. The seating die of claim 1 that further includes a retaining means for preventing the seating stem from passing out of said chamber.

3. The seating die of claim 1 wherein said spring means is a coil spring mounted in a loaded condition in said chamber between a housing end cap and said seating stem.

4. The seating die of claim 3 wherein said stop means includes an elongated shank that is axially aligned with the seating stem within said end cap and including adjusting means for axially positioning said shank within said chamber.

5. The seating die of claim 3 wherein said adjusting means further includes a micrometer having a graduated scale for axially positioning said shank.

* * * * *